United States Patent [19]

Stuttmann

[11] 4,017,035

[45] Apr. 12, 1977

[54] IMPACT CRUSHER WITH ADJUSTABLE IMPACT OR GRINDING MEANS

[75] Inventor: Jürgen Stuttmann, Munster, Germany

[73] Assignee: Hazemag Dr. E. Andreas KG, Munster, Germany

[22] Filed: July 24, 1975

[21] Appl. No.: 598,881

[30] Foreign Application Priority Data

July 27, 1974 Germany ..... 2436337

[52] U.S. Cl. ..... 241/189 R; 241/241; 241/289

[51] Int. Cl.[2] ..... B02C 13/06

[58] Field of Search ... 241/189 R, 189 A, 239–241, 241/287–289

[56] References Cited

UNITED STATES PATENTS

| | | | |
|---|---|---|---|
| 3,058,676 | 10/1962 | Hermann | 241/189 A UX |
| 3,117,735 | 1/1964 | Foyrey | 241/239 |
| 3,128,953 | 4/1964 | Wageneder | 241/241 |
| 3,199,798 | 10/1965 | Turner, Jr. | 241/230 X |
| 3,315,902 | 4/1967 | Pollitz | 241/231 |
| 3,684,196 | 8/1972 | Hankins | 241/240 X |

*Primary Examiner*—Roy Lake
*Assistant Examiner*—Howard N. Goldberg
*Attorney, Agent, or Firm*—Michael J. Striker

[57] ABSTRACT

An impact crusher wherein hard particulate material is comminuted during travel between a rotor provided with beaters and a pivotable impact or grinding means, the latter being mounted in the housing of the crusher at a level above the rotor and tends to pivot by gravity and/or by spring force in a direction to reduce the width of the gap between its lower portion and the periphery of the circle swept by the rotor beaters. The impact or grinding means is pivotable by feed screws which are articulately connected thereto and extend upwardly through openings in the top wall of the housing. The outer portions of the feed screws are rigid with a crosshead which can be moved up and down by a double-acting hydraulic cylinder and piston unit which has an appropriate lost motion to allow the impact or grinding means to yield in direction away from the rotor. When the cylinder and piston unit lifts the crosshead, additional cylinder and piston units can readily shift stepped or wedge-like inserts which are movable between the crosshead and the top wall of the housing to thereby determine the minimum width of the gap. The inserts can be engaged directly by the underside of the crosshead or by a platform which can be mounted beneath the crosshead. When the adjusting mechanism for the impact or grinding means employs a platform, packages of dished springs are inserted between the platform and the crosshead.

11 Claims, 4 Drawing Figures

IMPACT CRUSHER WITH ADJUSTABLE IMPACT OR GRINDING MEANS

BACKGROUND OF THE INVENTION

The present invention relates to comminuting apparatus for rock, concrete or the like, and more particularly to improvements in impact crushers of the type wherein a rotor provided with beater bars or the like entrains and propels material to be comminuted against one or more adjustable impact or grinding means.

It is already known to mount the impact or grinding means, hereafter called "impact means" for simplicity, for movement about a pivot axis which is parallel to the rotor axis and to bias the impact means toward the periphery of the rotor by one or more springs which assist the action of gravity and tend to reduce the width of the gap between the impact means and the path of movement of beater bars, or analogous comminuting elements at the periphery of the rotor. It is also known to couple the impact means to one or more elongated members (e.g., feed screws) which extend from the housing of the impact crusher and are connected to each other by a crosshead. The extent to which the impact means can pivot toward the periphery of the rotor is determined by one or more stops which are mounted at the outer side of the housing and are located in the path of movement of the crosshead. The crosshead can be moved relative to the housing by a suitable motor, e.g., a hydraulic cylinder and piston unit which is disposed between the housing and the crosshead. The connection between the cylinder and piston unit and crosshead and/or housing is designed to have a lost motion to enable the impact means to yield freely away from the rotor.

The extent to which the crusher can comminute material which is being fed into the housing to pass between the rotor and the breaker depends primarily on the width of the gap between the beating, elements at the periphery of the rotor and the nearest portion of the impact means. The adjustability (pivotability) of the impact means is intended to enable an operator to change the extent of comminuting action as well as to compensate for pronounced wear on those portions of the rotor and impact means which come into contact with the material to be comminuted. The mounting of the impact means in a selected angular position should not be rigid because the impact means must be capable of yielding (i.e., of increasing the width of the gap) if such gap receives one or more non breakable objects which are sufficiently large to necessitate a temporary widening of the gap. As mentioned above, the impact means normally tends to pivot nearer to the rotor, either by gravity alone or by gravity as well as under the action of one or more resilient elements in the form of helical springs or the like.

In certain types of presently known impact crushers, the width of the gap between the impact means and the circle swept by the beating elements of the rotor is changed by changing the positions of feed screws relative to the crosshead. This involves rotation of nuts which mesh with the feed screws at both sides of the crosshead. In view of the fact that many impact crushers are very large and are designed to comminute extremely hard substances, the dimensions of feed screws and nuts are also substantial which means that rotation of nuts relative to the feed screws necessitates the exertion of very pronounced effort. Moreover, the nuts are likely to jam because of the hard shocks they have to take up or to stick due to accumulations of dust in the threads of feed screws. Therefore, such nuts cannot always be manipulated by hand which contributes to the cost of the operation. Moreover, each and every adjustment necessitates a stoppage of the crusher because the likelihood of injury to attendants is much too great if the nuts are to be rotated while the beaters of the rotor propels solid particles against the impact means.

The manner in which the aforementioned cylinder and piston unit can be used to prevent or eliminate bridging of material in the interior of the housing of an impact crusher is disclosed in "Prinzip und Moeglichkeiten der Prallzerkleinerung" aus "Zement-Kalk-Gips" (Year 18, 1965, Vol. 11 pages 580–588). There is described the possibility of increasing the width of the gap between the rotor and the impact means; however, the publication does not offer any suggestion to locate and retain the impact means in any one of several selected positions. The main purpose of the construction which is disclosed in that publication is to relieve the nuts on the feed screws in order to facilitate manual rotation of the nuts. Such operation is time-consuming because the sequence in which the loosening of nuts and lifting of the crosshead take place changes in dependency on the desired direction of adjustment. Moreover, a person must climb onto the housing of the crusher in order to loosen the nuts. Purely hydraulic adjusting systems are too complex and the interval required for an adjustment is too long. Reference may be had to German Offenlegungsschrift No. 2,037,104.

SUMMARY OF THE INVENTION

An object of the invention is to provide an impact crusher with novel and improved means for changing the position of one or more impact or grinding means with respect to the rotor.

Another object of the invention is to provide an impact crusher wherein the position of the impact or grinding means relative to the rotor can be changed with little loss in time, without the exertion of any appreciable manual effort, and without any danger to attendants.

A further object of the invention is to provide an impact crusher wherein the width of the gap between the rotor and the orbit circle of the beaters of the impact or grinding means can be varied within any desired practical range and wherein the impact or grinding means invariably assumes (or can be caused to assume) a selected position with respect to the rotor.

An additional object of the invention is to provide the impact crusher with novel and improved adjusting means for pivoting the impact or grinding means between a plurality of positions and for locating the impact or grinding means in a selected position.

The invention is embodied in an impact crusher which comprises a housing having an inlet for material to be comminuted and an outlet for comminuted material, a rotor which is provided with beaters and mounted in the housing, an impact or grinding means which is also mounted in the housing for movement toward and away from the rotor and defines with the circle swept by the rotor beaters a gap through which the material passes on its way from the inlet toward the outlet whereby the material is comminuted by the rotor beaters and the impact or grinding means (the latter is preferably pivotable in the housing and tends to move nearer to the rotor under tha action of gravity and/or in response to bias of suitable resilient means), and adjusting means for varying the width of said gap.

The adjusting means comprises carrier means (e.g., a set of parallel feed screws) connected with the impact or grinding means and extending from the housing, holder means (e.g., a cross-head interconnecting the feed screws or a crosshead and a platform which latter is interposed between the cross-head and the housing) rigidly connected with the carrier means outside of the housing, motor means (preferably including a fluid-operated double-acting cylinder and piston unit) which is operable to move the holder means in a direction to increase the width of the gap (and preferably also in a direction to move the impact or grinding means nearer to the rotor and which has an appropriate lost motion to allow the impact or grinding means to freely yield away from the rotor, and at least one insert which is mounted on the housing and has portions of different thicknesses (such insert may constitute a wedge or it may be stepped with distinct shoulders between portions of different thicknesses). The insert is movable (preferably by one or more double-acting fluid-operated cylinder and piston units) between the holder means and the housing to thereby determine the minimum width of the gap depending on the thickness of that portion of the insert which has been placed between the housing and the holder means. A discrete insert may be provided for each feed screw, and each insert may be slotted to straddle the respective feed screw.

When the holder means comprises a crosshead and a platform, one or more sets of dished springs or analogous cushioning means may be interposed between the crosshead and the platform; the motor which moves the holder means is then connected between the platform and the housing.

The novel features which are considered as characteristic of the invention are set forth in particular in the appended claims. The improved impact crusher itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTs

Figure 1A:
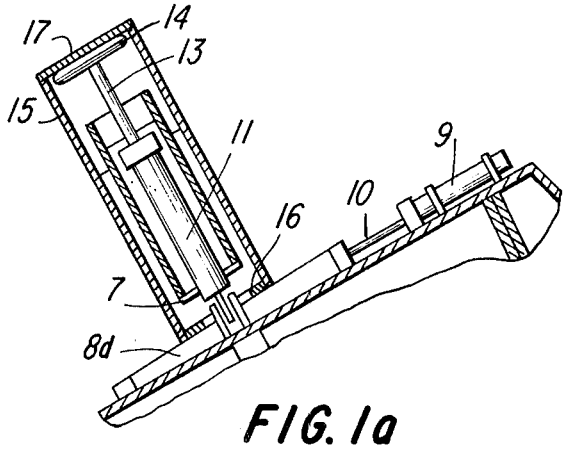
FIG. 1*a* is a fragmentary vertical section, showing a detail of a modification of the FIG. 1 embodiment.
Figure 1:
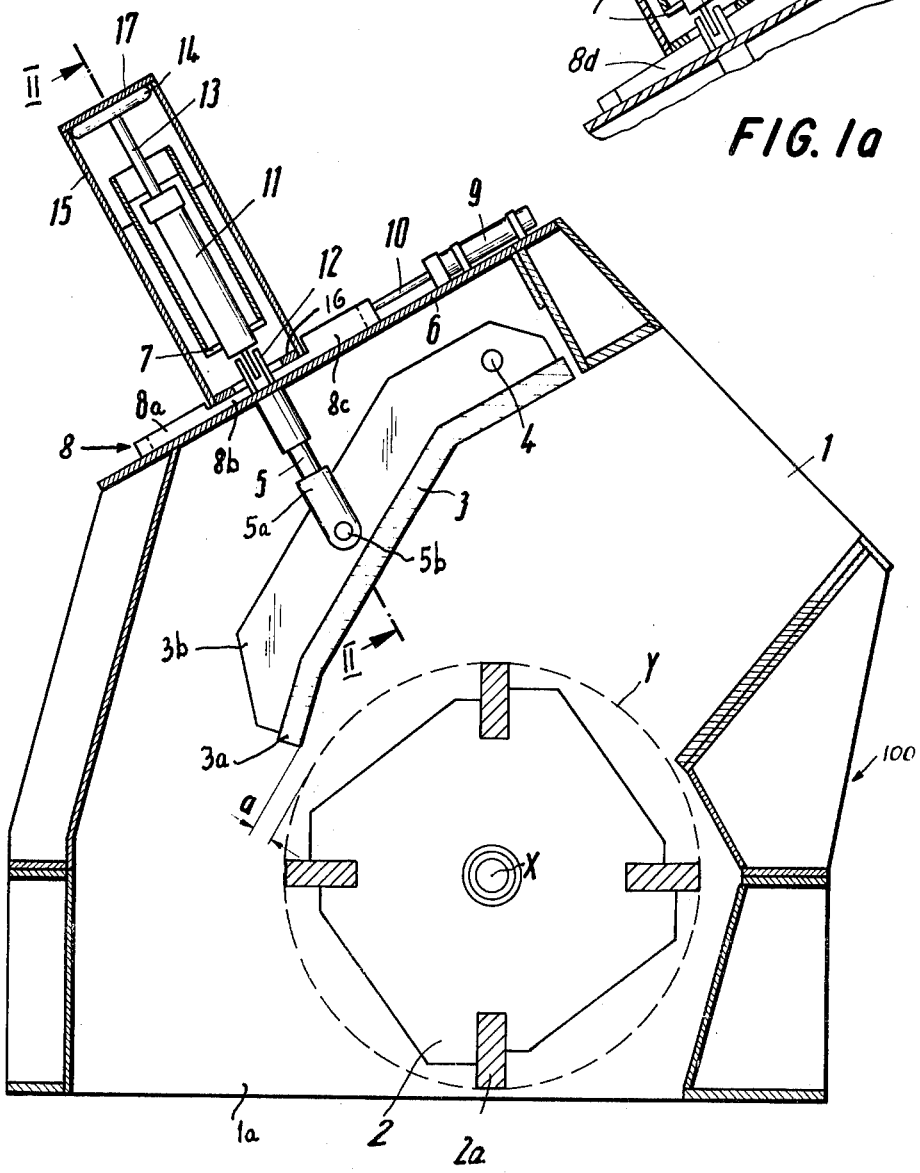
FIG. 1 is a schematic longitudinal vertical sectional view of an impact crusher which embodies one form of the invention.
Figure 2:
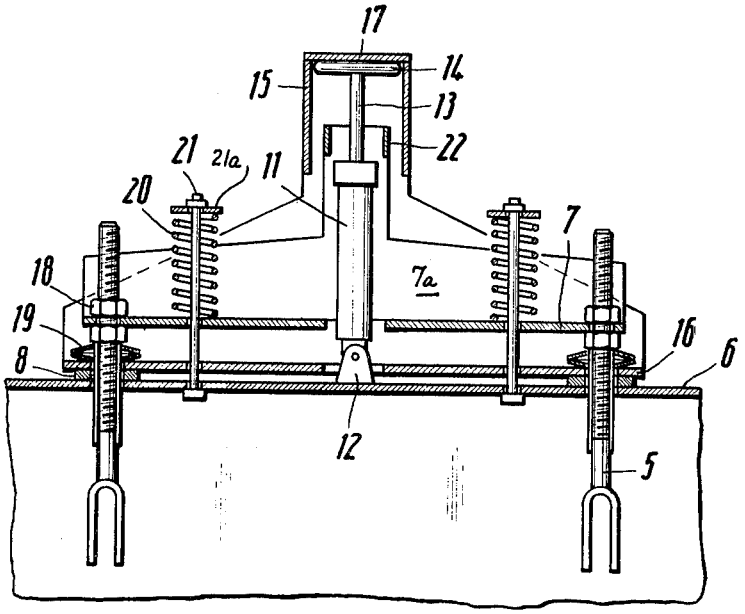
FIG. 2 is a fragmentary transverse sectional view substantially as seen in the direction of arrows from the line II–II of FIG. 1.

Referring first to FIGS. 1 and 2, there is shown an impact crusher which comprises a housing 100 having an inlet 1 and an outlet 1*a*. The housing supports a rotor 2 which can be driven to rotate in a counterclockwise direction, as viewed in FIG. 1, and carries an annulus of customary beater bars or analogous beating elements 2*a*. Such beating elements are mounted at the periphery *y* of the rotor 2. The reference character X denotes the horizontal axis of the shaft which drives the rotor 2, in counterclockwise direction.

The top wall 6 of the housing 100 is located above an impact plate 3 which is mounted on a horizontal pivot member 4 so that its lower portion 3*a* can move nearer to or further away from the path of orbital movement of beating elements at the periphery *y* of the rotor 2. Thus, the width of the gap *a* between the impact plate 3 and the rotor 2 can be changed by pivoting the impact plate about the axis of the member 4. The latter is mounted in the side walls of the housing 100.

The adjusting means for pivoting the impact plate 3 with or relative to the member 4 comprises two parallel elongated carriers 5 here shown as feed screws 5 having bifurcated lower end portions 5*a* which are articulately connected to a rib 3*b* at the upper side of the impact plate by pins 5*b*. The feed screws 5 extend outwardly and upwardly through openings in the top wall 6 and are coupled to each other by a traverse or crosshead 7 forming a holder means. The crosshead 7 is indirectly supported by the top wall 6 through the intermediary of shiftable inserts 8 which abut against the outer side of the top wall and are disposed below a platform 16. The means for shifting the inserts 8 along the outer side of the top wall comprises fluid-operated (preferably hydraulic) motors here shown as double-acting hydraulic cylinder and piston units having cylinders 9 and piston rods 10. Each cylinder 9 is fixed to the top wall 6 and the piston rods 10 are attached to the respective inserts 8. It is clear that a single cylinder and piston unit can be used to move all of the inserts 8 in unison.

The adjusting means for pivoting the impact plate 3 further comprises an additional fluid-operated (preferably hydraulic) motor having a double-acting cylinder 11 and a piston rod 13 which is coupled to a plate-like guide 14. The lower end portion of the cylinder 11 is articulately connected to upwardly extending lugs 12 of the top wall 6; such lugs extend through openings in the platform 16. The guide 14 at the upper end of the piston rod 13 is reciprocable in an elongated casing or support 15 having a cover or lid 17 above the guide 14 and being mounted on the platform 16.

The crosshead 7 is secured to the feed screws 5 by pairs of nuts 18 and the lower nut of each pair is biased upwardly by a set of dished springs 19 reacting against the upper side of the platform 16. As mentioned above, the platform 16 overlies the inserts 8 which are slotted to enable them to move transversely of the respective feed screws 5 and to prevent the feed screws 5 from being subjected to bending stresses.

The crosshead 7 is biased toward the outer side of the top wall 6 by helical springs 20 which bear against the upper side of the crosshead and react against retainers 21*a* at the upper ends of rods 21 whose lower end portions are anchored in the top wall 6. The rods 21 extend through openings in the platform 16 and crosshead 7. It will be noted that the springs 20 tend to pivot the impact plate 3 in a counterclockwise direction, as viewed in FIG. 1, so as to reduce the width of the gap *a*. The crosshead 7 has upwardly extending side panels or cheeks 7*a* for stops 22 which can be engaged by the guide 14 at the upper end of the piston rod 13.

The structure which is shown in FIG. 1 and 2 protects the threads of the feed screws 5 and nuts 18 against excessive shocks which could develop when the impact plate 3 has yielded in response to penetration of relatively large nonbreakable objects through the gap *a* and has thereupon pivoted back toward the orbit *y* of the beaters of the rotor 2. The dished springs 19 absorb such shocks by undergoing deformation between the platform 16 and crosshead 7. These springs are lifted with the platform 16 when the operator decides to change the width of the gap which can be increased or reduced, depending upon whether the operator decides to place relatively thick or relatively thin portions of inserts 8 between the wall 6 and platform 16.

In a relatively small impact mill, the springs 19 can be dispensed with because the stresses due to movements of the masses can be controlled by appropriate dimensioning of threads on the feed screws and nuts as well as by appropriate dimensioning of the hydraulic cylinder and piston unit 11, 13.

Figure 3:
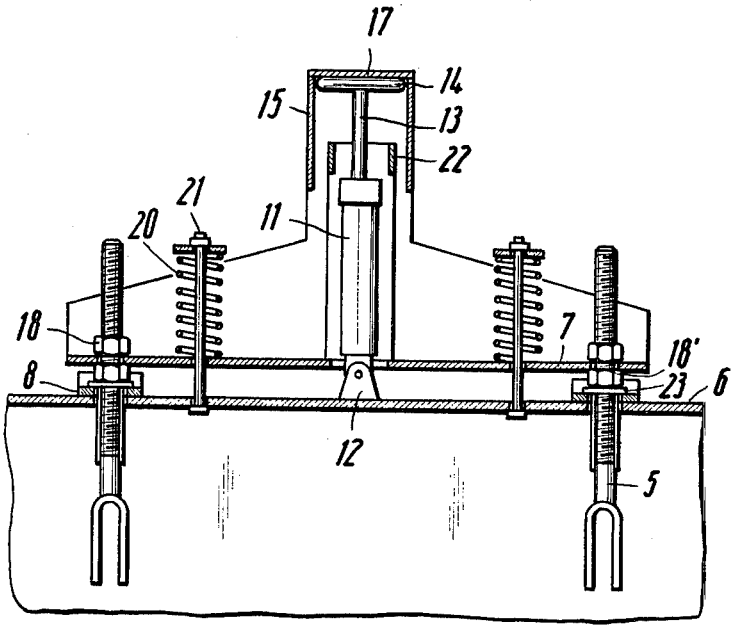
FIG. 3 is a similar fragmentary transverse sectional view of a modified impact crusher.

FIG. 3 shows a simplified impact mill wherein the casing 15 is rigid with the crosshead 7. The latter is rigidly connected to the feed screws 5 by nuts 18, 18' and carries the stops 22 which can cooperate with the guide 14 on the piston rod 13. The lower nuts 18' are located immediately above disk-shaped washers 23 which, in turn, abut against the upper sides of adjacent portions of the inserts 8. These inserts can be shifted in the same way as shown in FIG. 2.

If the operators wish to increase the width of the gap a, e.g., to increase the width from a relatively small to a median or average value, the piston rod 13 of FIG. 2 is caused to move upwardly so as to push the guide 14 against the cover 17 of the casing 15. The platform 16 lifts the crosshead 7 through the medium of dished springs 19 and lower nuts 18 whereby the nuts lift the feed screws 5 and pivot the impact plate, 3 clockwise, as viewed in FIG. 1. (in FIG. 3, the casing 15 is rigid with the platform 7; therefore, the latter will lift the feed screws 5 by way of the upper nuts 18). The impact plate 3 is pivoted against the action of gravity as well as against the resistance of helical springs 20 which tend to pivot the impact plate counterclockwise, as viewed in FIG. 1. This means that the lifted platform 16 (FIG. 2) or the lifted crosshead 7 (FIG. 3) does not urge the inserts 8 against the upper side of the top wall 6. Consequently, the motors including the cylinders 9 can easily shift the inserts 8 in the longitudinal direction of the respective piston rods 10. The inserts 8 have portions of different thickness so that, when the fluid pressure in the lower chamber of the cylinder 11 (below the piston) is reduced, the impact plate 3 can pivot by gravity or spring force to assume a position which is determined by the thickness of insert portions below the respective dished springs 19 (FIG. 2) or lower nuts 18' (FIG. 3). FIG. 1 shows that an insert 8 may have three portions 8*a*, 8*b*, 8*c* of different thickness. The thickness of the median portion 8*b* is less than that of the outer portion 8*a* or 8*c*, and the thickness of portion 8*a* is less than that of portion 8*c*. Thus, the portion 8*a* will be placed below the platform 16 if the width of the gap *a* is to be an average width, the portion 8*b* will be located below the platform 16 if the width of the gap *a* is to be reduced to a minimum value, and the portion 8*c* will be shifted below the platform 16 if the width of the gap *a* is to be increased to a maximum value.

It will be noted that the mechanisms shown in FIGS. 2 and 3 allow the impact plate 3 to yield (by pivoting clockwise, as viewed in FIG. 1) if the beating elements of the rotor 2 introduce a bulky and non breakable object into the gap *a* adjacent the lower portion 3*a* of the impact plate. The feed screws 5 then merely lift the crosshead 7 which stresses the springs 20. It will be recalled that the feed screws 5 shown in FIG. 2 are free to move up or down in openings provided therefor in the platform 16.

The cylinder 11 could be replaced with a single-acting cylinder since it is normally only necessary to lift the crosshead 7 so as to allow for shifting of inserts 8 with a minimum of effort. However, it is presently preferred to use a double-acting cylinder 11 for the following reasons: Particulate material flying around in the interior of the housing 100 is likely to accumulate on the walls of the housing and on the impact plate so as to jam the impact plate in the housing. Therefore, the force furnished by the relatively weak helical springs 20 and/or gravity might not suffice to cause the impact plate 3 to pivot counterclockwise (as viewed in FIG. 1) when the pressure in the lower chamber of the cylinder 11 is reduced or terminated (i.e., upon completed adjustment of the inserts 8). The upper chamber of the cylinder 11 then receives pressurized hydraulic fluid which causes the guide 14 to bear against the stops 22 and to push the crosshead 7 downwardly whereby the crosshead pushes the feed screws 5 in a direction to pivot the impact plate 3 counterclockwise until the platform 16 comes to rest on the adjusted inserts 8 or until the inserts 8 are engaged by the washers 23 shown in FIG. 3.

The stepped inserts 8 can be replaced by wedges 8*d* which can be moved to a practically infinite number of different positions to thereby effect desired changes in the minimum width of the gap *a*. This is shown in FIG. 1*a* which otherwise is the same as FIG. 1, although parts of FIG. 1 have been omitted for simplicity.

The various motors can be started or arrested by depressing knobs or analogous actuating elements on a control panel which can be placed close to or at any desired distance from the crusher.

The springs 19 of FIG. 2 or analogous cushioning means perform an additional useful function, namely of protecting the motor 11, 13 against excessive shocks if the adjustment takes place while the crusher is in operation. The springs 19 take up shocks which develop when the impact plate 3 is lifted by material during adjustment and is thereupon allowed to pivot toward the rotor under the action of gravity. In the absence of such springs, the just discussed shocks would have to be taken up by the cylinder 11, piston rod 13 and/or by hydraulic fluid which operates the cylinder.

The clearances with which the feed screws 5 extend through the top wall 6 and the clearances between various articulately connected parts are selected with a view to insure unobstructed pivoting of the impact plate 3 by gravity, under the action of springs 20, in response to upward movement of the piston rod 13 and/or in response to downward movement of the piston rod 13 (when the guide 14 bears against the stops 22).

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. In an impact crusher, a combination comprising a housing having an inlet for material to be comminuted and an outlet for comminuted material; a rotor provided with beaters and mounted in said housing; an impact or grinding means mounted in said housing for movement toward and away from said rotor and defining therewith a gap through which the material to be comminuted passes on its way from said inlet toward said outlet and is comminuted by said rotor beaters and said impact or grinding means; and adjusting means for varying the width of said gap, having a lost motion to allow the impact or grinding means to yield in direction away from said rotor and including carrier means connected with said impact or grinding means and extending from said housing, holder means connected with said carrier means outside of said housing, motor means operable to move said holder means at least in a direction to increase the width of said gap, and at least one insert mounted at the other side of said housing and having portions of different thicknesses, said insert being movable between said holder means and said housing to thereby determine the minimum width of said gap depending on the thickness of that portion of said insert which is located between said housing and said holder means.

2. A combination as defined in claim 1, further comprising second motor means for moving said insert with respect to said housing and said holder means.

3. A combination as defined in claim 1, wherein said carrier means comprises a plurality of discrete carriers and said holder means comprises a crosshead rigid with said carriers.

4. A combination as defined in claim 1, wherein said adjusting means further comprises a platform interposed between said holder means and said insert, said adjusting means further comprising yieldable cushioning means interposed between said holder means and said platform.

5. A combination as defined in claim 4, wherein said cushioning means comprises at least one set of dished springs.

6. A combination as defined in claim 4, wherein said motor means comprises a fluid-operated cylinder and piston unit connected between said platform and said housing.

7. A combination as defined in claim 1, wherein said motor means comprises a double-acting fluid-operated cylinder and piston unit.

8. A combination as defined in claim 1, wherein said impact or grinding means is pivotable in said housing and normally tends to move nearer to said rotor under the action of gravity.

9. A combination as defined in claim 1, further comprising means for biasing said holder means against said insert.

10. A combination as defined in claim 1, wherein said insert is a wedge.

11. A combination as defined in claim 1, wherein said insert is stepped.

* * * * *